United States Patent [19]

Stelson et al.

[11] Patent Number: 5,050,089

[45] Date of Patent: Sep. 17, 1991

[54] CLOSED-LOOP CONTROL SYSTEM

[75] Inventors: Kim A. Stelson, Edina; Woon-Chung Wang, Minneapolis, both of Minn.

[73] Assignee: Regents of the University of Minnesota, St. Paul, Minn.

[21] Appl. No.: 404,796

[22] Filed: Sep. 8, 1989

[51] Int. Cl.[5] ..... B21D 7/12

[52] U.S. Cl. ..... 364/474.07; 72/702; 364/560

[58] Field of Search ..... 364/474.07, 508, 506, 364/505, 560; 72/702

[56] References Cited

U.S. PATENT DOCUMENTS

| | | | |
|---|---|---|---|
| 3,352,136 | 11/1967 | Clarke | 72/702 |
| 3,821,525 | 6/1974 | Eaton et al. | 72/702 |
| 3,919,875 | 11/1975 | Maev et al. | 72/369 |
| 4,408,471 | 10/1983 | Gossard et al. | 72/21 |
| 4,486,841 | 12/1984 | Koyama et al. | 364/474.07 |
| 4,633,720 | 1/1987 | Dybel et al. | 364/506 X |

*Primary Examiner*—Parshotam S. Lall
*Assistant Examiner*—S. A. Melnick
*Attorney, Agent, or Firm*—Kinney & Lange

[57] ABSTRACT

A tube bending die rotates to cause the tube to be bent over the outer periphery of the die and uses a drive which includes a transducer for measurement of the bending moment required for bending the tube. The bending moment signal is used in conjunction with a signal indicating the total amount of bend to control the number of degrees of bending and to overbend the tube an amount which is a function of the bending moment required to bend the tube, to compensate for springback. In its simplest form, the bending die is a rotating element, and the drive for rotating the die can include a force measuring link which can be converted into bending moment required for bending is used as a measured parameter for an equation which provides a signal indicating the amount of angular overbending needed to compensate for springback in an online, real time process.

11 Claims, 5 Drawing Sheets

CLOSED-LOOP CONTROL SYSTEM

BACKGROUND OF THE INVENTION

1. Field of the Invention

The present invention relates to online, automatically compensated tube benders which compensate for springback.

2. Description of the Prior Art

Various devices have been advanced for attempting to compensate for spring back, but most require fairly complex instrumentation and calculations. U.S. Pat. No. 3,821,525, issued June 28, 1974, illustrates a method and apparatus for automatically compensated tube bending, which uses instrumentation for detecting springback, through a springback detector at the tube clamping die, and which then utilizes the information about the amount of detected spring back for controlling further bends. A calibration run using a tube of the desired material is needed, and the information therefrom is used to produce subsequent tubing of the same characteristics. The subsequent tubing must have the same or sufficiently similar characteristics to make the bending reliable.

The present device is most suited for online bending of tubes that require multiple bends, so that the tubes can be bent precisely and automatically using the desired parameters.

SUMMARY OF THE INVENTION

An apparatus and method for bending tubing, having a multiple number of bends uses a standard bending die. As shown, a die that rotates while the tube is clamped in place is used. The tube is guided with a wiper or pressure pad to reduce the tendency of the tube to flatten as the tube is bent around and against the outer periphery of the die. The die has a drive that includes a sensor for measuring the bending moment necessary for making the desired bend, and controls use the bending moment as a parameter for automatically providing a desired overbend for that particular tube to compensate for springback when the die is released.

The drive or power element for rotating the bending die is controlled by a computer. The bending moment being exerted is measured through the use of a force transducer or link and an encoder provides a signal indicating the amount of rotation of the die. The die position signal and the load signal are used as inputs to determine the bending moment characteristics of the tube. The information relating to the desired degree of bend is stored in the computer, and calculations are made online to determine the required number of degrees or angle of overbend for achieving the desired finished bend of that particular tube.

In addition, the amount of distortion of the tube during bending and its effect on springback can be programmed by empirical formulas into the computer. Measured, historical and experimental information on the bending characteristics of tubing are used for providing compensation factors in the equations or formulas developed for determining the amount of overbend needed for each individual bend.

Analysis will show that the location of the neutral axis in any cross section of a homogeneous material coincides with the centroid of that cross section and thus the displacement of the neutral axis can also be calculated.

The ductility of the material will determine the minimum center line radius of the bend for any given tube, but in general, designing a bend to the largest practical radius makes the bend easier to form. Thus, practical limitations on the bend radius are applied, and the present invention relates to bends where the radius is selected in relation to tube size so that there will be no failure of the tube material.

DETAILED DESCRIPTION OF THE PREFERRED EMBODIMENTS

Figure 1:
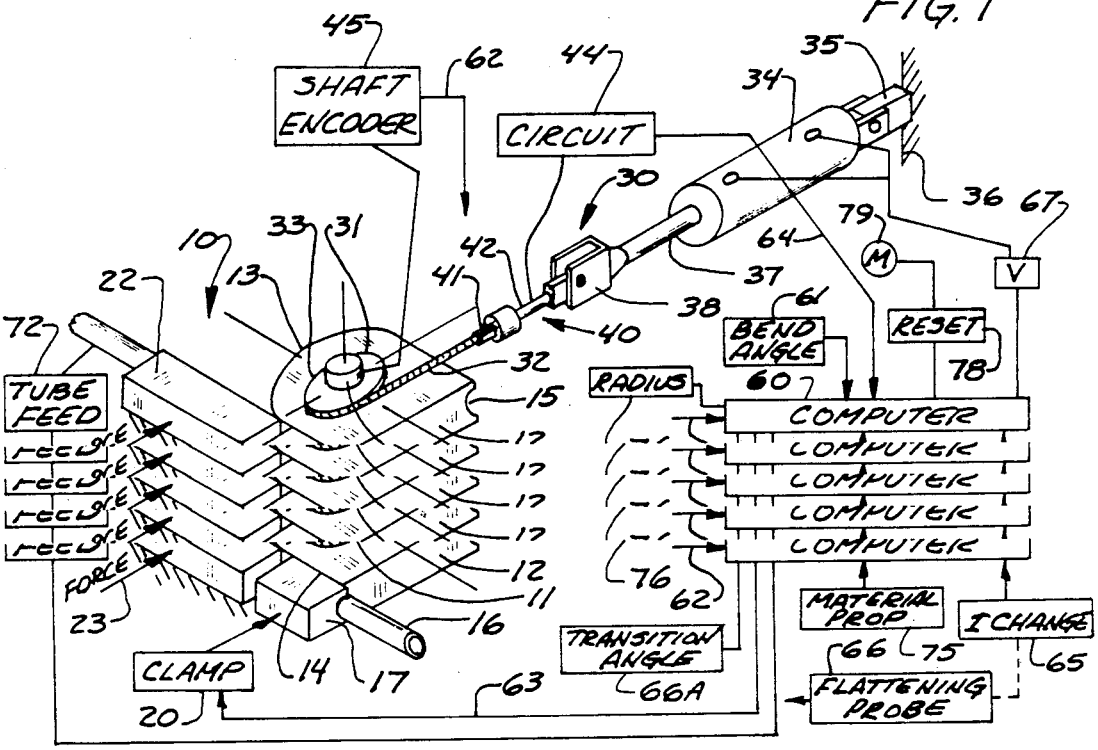
FIG. 1 is a schematic representation of a bending die having a force measuring component therein.
Figure 2:
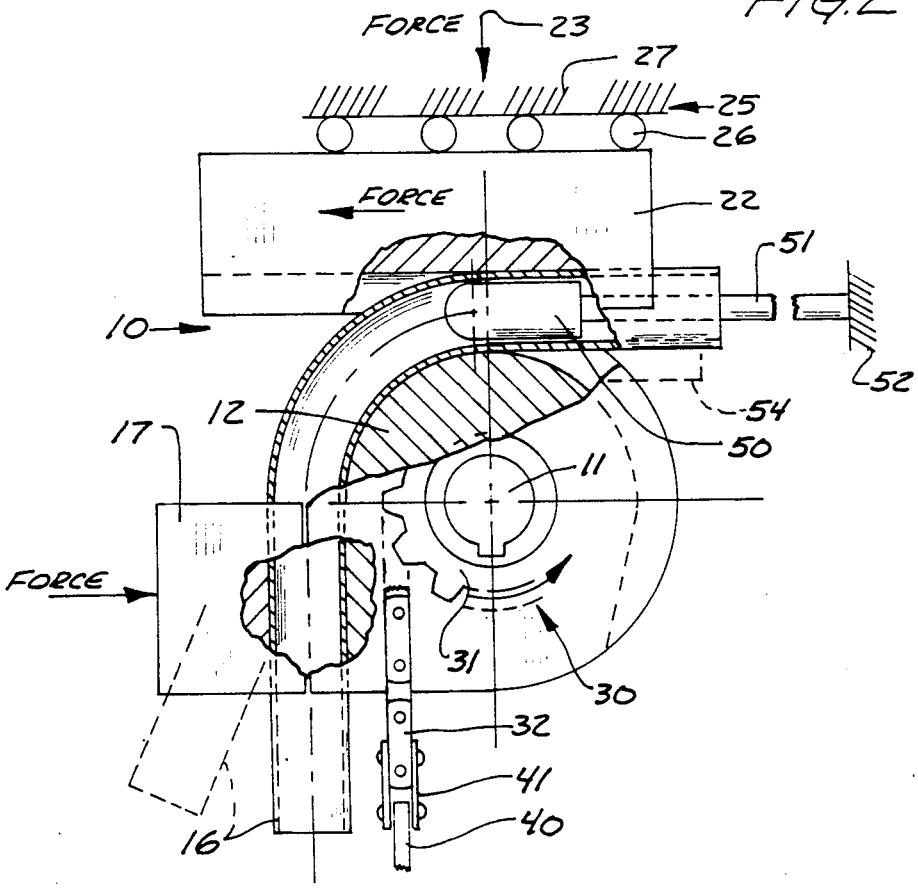
FIG. 2 is a top plan schematic view of a the bending die of FIG. 1 after a tube held therein has been bent, and schematically showing a mandrel used in certain bending instances.

FIGS. 1 and 2 are schematic representations of typical apparatus for bending a tube. Much of the detail is not shown, but reference to the type of apparatus for the bending die is illustrated in the prior mentioned U.S. Pat. No. 3,821,525. As shown, a bending die assembly indicated generally at 10 has a main mounting shaft 11 that is rotatably mounted in a suitable support held on a frame. The shaft supports and drives a tube bending die 12 of conventional design. The tube bending die 12 has a part cylindrical outer peripheral portion 13, and at least one straight section 14, at its outer periphery. The perimeter of the part cylindrical portion is formed at a radius with respect to the center or axis of the shaft 11. The outer peripheral surface has a part cylindrical groove or receptacle 15, which is made to receive the particular size tube 16 that is to be bent. In addition, a conventional clamp block 17 is provided and actuated from a clamp assembly illustrated schematically at 20. The clamp block 17 clamps the tube 16 against the straight section 14 of the bend die periphery. The tube 16 is locked in place on the die so that when the bend die 12 is rotated, the tube 16 will move along with the bend die causing the bend to be formed around the part cylindrical outer periphery portion 13.

A pressure die indicated schematically at 22 is provided adjacent the bend die, and is held with a suitable clamp providing a force indicated by arrow 23. The clamp force can be provided preferably with a hydraulic cylinder. The pressure die will travel along with the tube as the bend die is rotated. FIG. 2 schematically shows a completion of a bend, and the pressure die 22 is also shown schematically supported on a suitable roller guideway 25, which includes rollers 26 that roll against the pressure die 22 and which are supported relative to a support frame 27. A force indicated by arrow 23 is applied to the support 27 to retain the pressure die in position.

In the present invention, the measurement of the bending moment that is actually exerted on the tube 16 is necessary, and in order to rotate the bending die and measure or calculate the bending moment being exerted on the tube being bent, a drive assembly indicated generally at 30 is provided. The drive assembly 30 includes a drive sprocket 31 that is driveably mounted to the mounting shaft and thus is secured with respect to the bending die 12. The sprocket 31 is concentric with the axis of rotation of the bending die 12 and one end of a chain 32 is attached to the sprocket 31 in a suitable manner, such as with a pin or bolt 33. The force needed for rotating the bending die 12 is applied by placing a tension on the free portion of the chain that tends to rotate the sprocket 31. A fluid pressure actuator 34, which can either be air or hydraulic, has its base end connected with a bracket 35 to a support 36, and has an internal piston which can be operated to extend or retract a rod 37. The outer end of the rod 37 has a clevis 38 that is coupled to one end of a force or load transducer 40. The load transducer 40 has its opposite end connected with a suitable connection 41 to the free end of the chain 32. The load transducer 40, as shown, has a midsection 42 which carries strain gauges or similar load sensing devices, which can be connected to a conditioning circuit illustrated at 44 for providing an output signal indicating the load or force carried by the sensor 40, which is directly proportional to the bending moment being exerted on the bending die 12.

A shaft encoder of suitable design indicated at 45 is provided to determine the amount of rotation of the shaft 11 from a reference position. This encoder 45 can be an optical encoder, or other suitable, similar shaft encoder that provides an output signal indicating change in angular position of the bending die. This will provide a signal that indicates the degrees of bend of the tube.

In FIG. 2, the bend die 12 is shown after completion of a bend, showing the tube 16 in dotted lines at an anticipated springback position of the tube after the bend. A mandrel indicated generally at 50 is shown inserted in the tube 16 to prevent excessive flattening. Mandrel 50 has a long anchor rod 51 that is anchored relative to a frame 52. The rod 51 passes through the interior of the unbent portion of the tube 16.

A wiper die indicated in dotted lines at 54 can also be used. It fits adjacent the bend die and against the tube 16 to guide the tube and aid in preventing wrinkling on the inner wall of the tube at the bend.

The die construction itself is substantially conventional and is thus shown only schematically.

The measurement of the bending moment is used for online calculation and determination of the amount of overbend necessary to compensate for springback.

Figure 5:
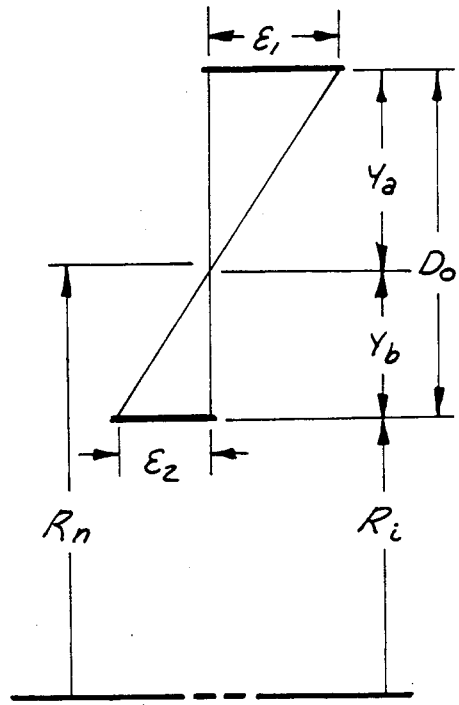
FIG. 5 is a graphic representation of the elongation of the tube wall.
Figure 4:
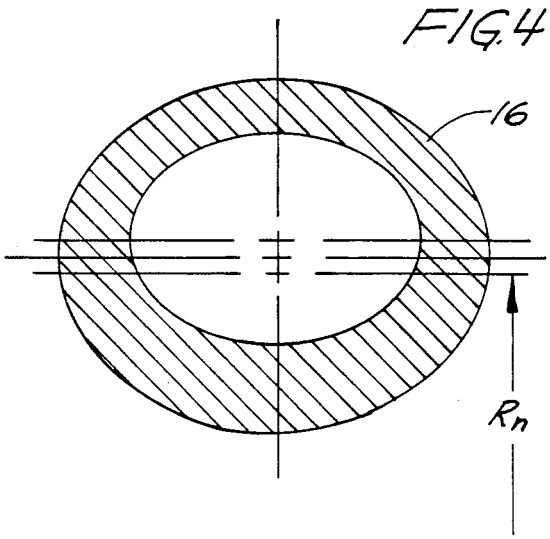
FIG. 4 is a schematic cross-sectional view of a tube showing the shift in the neutral or unstretched axis from bending.

In analyzing the bending of tubing, it is known that the cross section becomes oval or flattened, and that this distortion of the tube cross section involves changes in wall thickness, with the tube wall on the outside of the bend becoming thinner and the tube wall on the inside of the bend becoming thicker. The cross section of the tube is approximately elliptical after the bend. Such an elliptical cross sectional configuration and differences in wall thicknesses is shown in FIG. 4. FIG. 5 illustrates the relationship between strain at the inner side of the bend and the outer side of the bend so analysis of the bend can be made.

FIG. 5 represents the condition of a distorted tube segment shown in FIG. 4 and shows the neutral axis shift. The recognition of the flattening and neutral axis shift permits defining the changes in terms of the moment of inertia.

If $y_b$ denotes the distance between the neutral axis and the inner surface of the bend and $y_a$ denotes the distance between the neutral axis and the outer surface of the bend, as shown in FIG. 5, then:

$$y_a+y_b=D_o$$

$$e_1/e_2=y_a/y_b$$

From the equations immediately above and the experimental results from Table I, $y_a$ and $y_b$ on each individual segment can be calculated. $R_n$, the distance between the neutral axis and the centerline of the bend die, is equal to $R_i+y_b$. Then, using mathematical analysis and known material properties for the tube material, the bending moment can be calculated for each tube segment listed in Table I and the bending moments for the transition sections and the center circular track section can be calculated. e is the engineering strain above.

It also has been observed that the cross section of the tube 16 is not uniform throughout the bend. It also has been determined experimentally that the moment distribution is nearly uniform in the center of the bend in spite of the nonuniform distortion of each cross section. In the bend "transition" regions, where the center line of the tube changes from being straight to being substantially along a circular track, the bending moment varies almost linearly with the bend angle. The bending moment varies from zero at the outer end of the bend to a constant value observed in the middle portion of the bend. The transition region is in the order of five degrees and can be determined experimentally. Using a calculation based upon a five degree transition section at each end is satisfactory.

Figure 3:
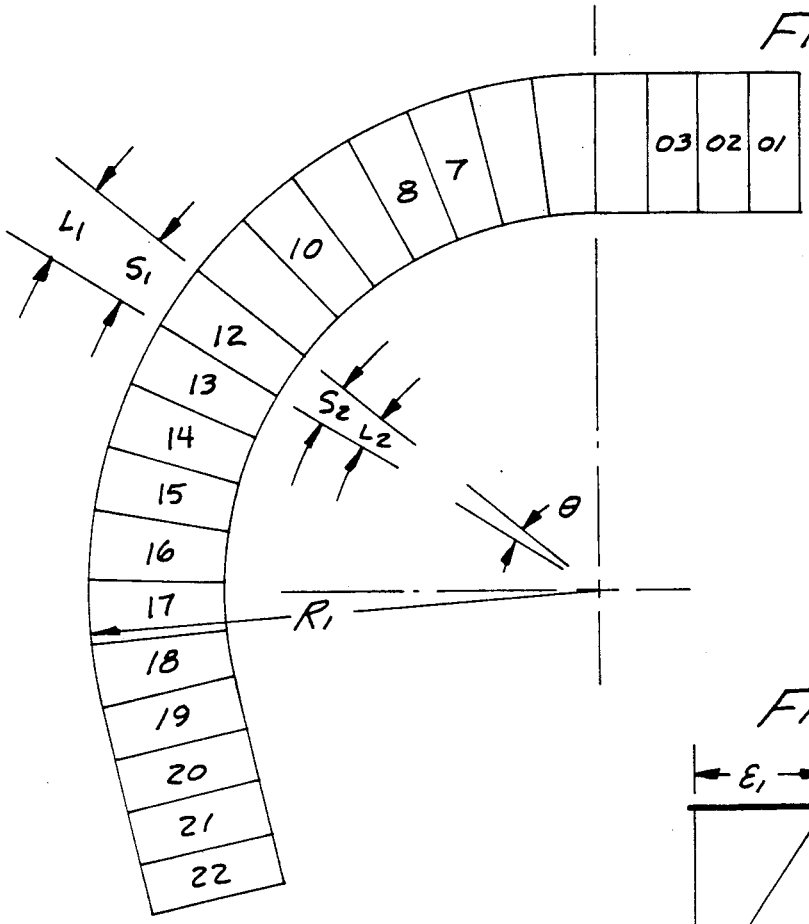
FIG. 3 is a layout of the bent tube of FIG. 2 divided into sections to illustrate the differences in shape at different portions of a tube bend section.

In an experimental setup, the length of tube forming the bend was marked every 0.3 inches into 22 segments as shown in FIG. 3. After bending, the length of the inner and outer surfaces, and the diameter of the tube in each consecutive segment were measured optically, and the differences in the measured straight length provides a determination of the strain differential across the bend. This also determines the strain in each of the marked segments.

Table I lists the lengths and diameters of the marked segments of FIG. 3. The analysis for using and deriving the information is set out below:

The arc length of each segment, S, can be calculated from its projected straight length, L, which can be measured. From FIG. 3, it is seen that $\Theta/2=S_1/2R_1$ and $\sin(\Theta/2)=L_1/2R_1$. Combining these two equations gives:

$$\sin(S_1/2R_1)=L_1/2R_1 \quad (A)$$

From the Taylor's series approximation, the following is shown:

$$\sin x=x-x^3/6 \quad (B)$$

Combining equation (A) and (B) gives:

$$\sin(S_1/2R_1)=(S_1/2R_1)-(S_1/2R_1)^3/6=L_1/2R_1$$

$$S_1[1-(S_1^2/24R_1^2)]=L_1$$

It is sufficiently accurate for these purposes to set $S_1^2=L_1^2$. Substituting $L_1^2$ for $S_1^2$ and solving the equation gives:

$$S_1=L_1/(1-L_1^2/24R_1^2)$$

The same procedure can be followed for the inner arc. This will be:

$$S_2=L_2/(1-L_2^2/24R_2^2)$$

The engineering strain in the outer surface is:

$$e_1=(S_1-L_o)/L_o$$

and the engineering strain in the inner surface is:

$$e2=(S_2-L_o)/L_o$$

For the outer surface, therefore, true strain is expressed as:

$$\epsilon = \ln\left[1+\frac{(S_1-L_1)}{L_0}\right]$$

For the inner surface of the bend true strain is expressed as:

$$\epsilon = \ln\left[1+\frac{(S_1-L_1)}{L_0}\right]$$

where ln is the natural logarithm and $L_o$ is the original length of each tube segment.

The true strain is used for calculating bending moment distribution along the bend sections shown in FIG. 3. This is done by calculating the corresponding true stress, know from a materials test, for each value of true strain and integrating over each cross section. These calculations were used to provide the distribution curves shown in FIG. 9.

TABLE I

| Segment | $L_1$ (in.) | $L_2$ (in.) | $D_O$ (after deformation) (in.) |
|---|---|---|---|
| 1 | .300 | .300 | 1.043 |
| 2 | .302 | .300 | 1.041 |
| 3 | .307 | .295 | 1.036 |
| 4 | .319 | .291 | 1.026 |
| 5 | .337 | .284 | 1.000 |
| 6 | .344 | .262 | .969 |
| 7 | .356 | .257 | .961 |
| 8 | .364 | .247 | .955 |
| 9 | .374 | .246 | .946 |
| 10 | .374 | .240 | .939 |
| 11 | .377 | .239 | .935 |
| 12 | .377 | .242 | .931 |
| 13 | .374 | .241 | .934 |
| 14 | .374 | .245 | .937 |
| 15 | .369 | .246 | .943 |
| 16 | .358 | .251 | .953 |
| 17 | .350 | .257 | .971 |
| 18 | .334 | .264 | .992 |
| 19 | .326 | .276 | 1.015 |
| 20 | .315 | .286 | 1.030 |
| 21 | .312 | .296 | 1.039 |

TABLE I-continued

| Segment | $L_1$ (in.) | $L_2$ (in.) | $D_O$ (after deformation) (in.) |
|---|---|---|---|
| 22 | .302 | .299 | 1.0425 |

Figure 7:
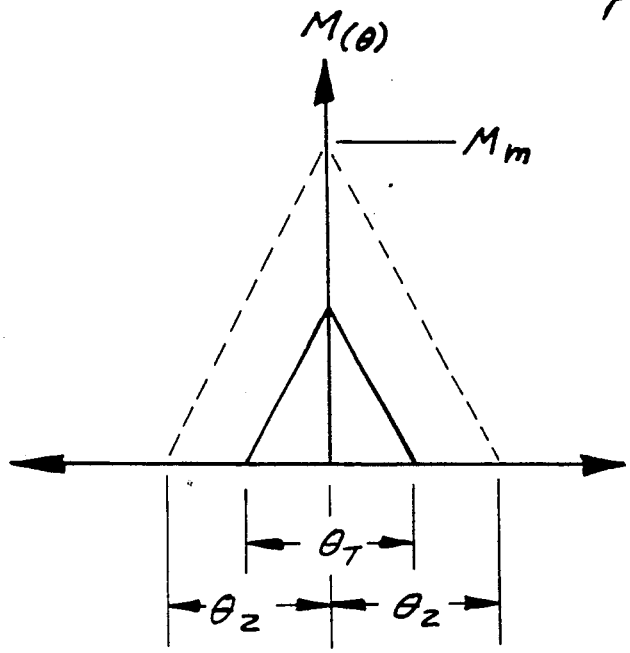
FIG. 7 is a schematic representation showing the bending moment distribution in two different conditions of bending.
Figure 6:
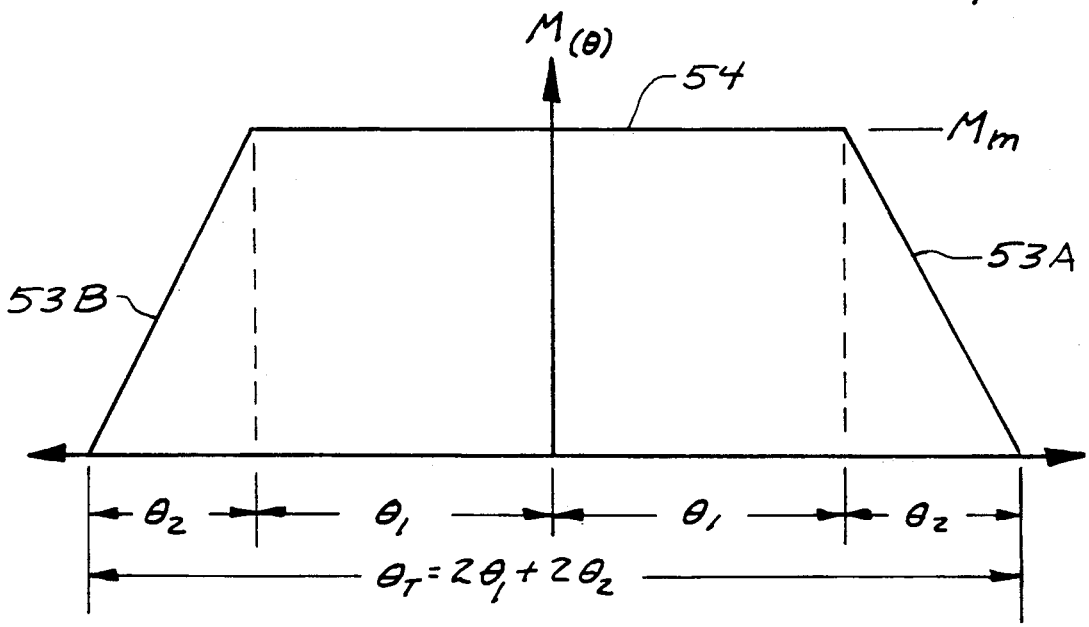
FIG. 6 is a graphic representation of a bending moment distribution of a bend that has more than twice the transition angle for the bend.

The bending moment can be assumed to be distributed along the bend angle as shown in FIGS. 6 and 7. In FIG. 6, the total bend angle, $\Theta_T$ is made up of two portions, $2\Theta_1$ and $2\Theta_2$. The measured bending moment $M_m$ is substantially constant on the plot section 54 where the bend radius is also substantially constant. This section is also indicated by $2\Theta_1$. Two transition regions 53A and 53B of angle, $\Theta_2$, are located near each end of the bend. The bending moment varies linearly in these regions as shown by the straight inclined line segments 53A and 53B at the ends of the plot.

If the total bend angle, $\Theta_T$, is less than twice the transition angle, $2\Theta_2$, the triangular moment distribution of FIG. 7 is the correct distribution and comprises the end segments shown in FIG. 6. The slope of the moment versus angle curve in the transition region is the same, with a sufficient accuracy, regardless of whether the total bend angle is twice the transition angle or not. The measured bending movement and an input of the transition angles, which can be determined experimentally as well as the total bend angles, which is selected or known, provides the information for determining springback.

Figure 8:
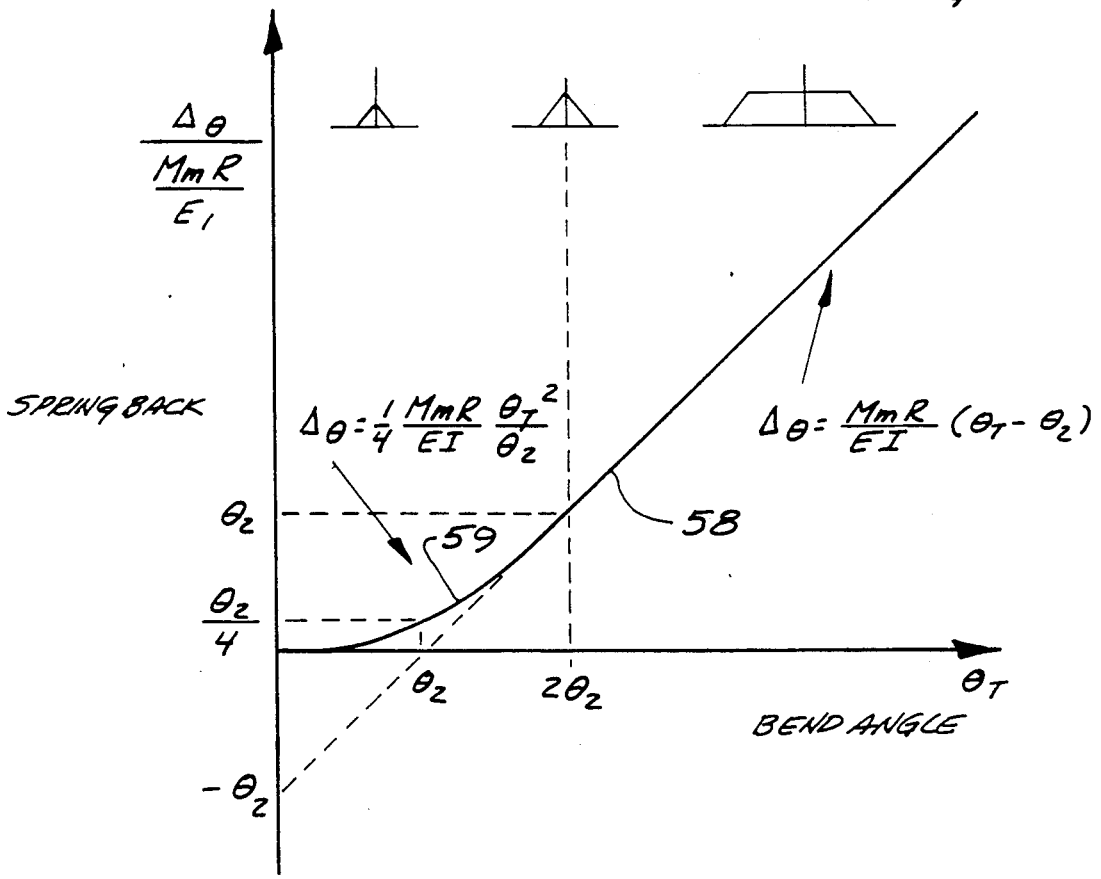
FIG. 8 is a graphic representation illustrating spring back versus bend angle derived from equations useful for providing online determination and control of the required amount of overbending needed to compensate for springback.

The springback is calculated based on whether the total bend angle is greater than twice the transition angle or not as shown in FIG. 8. If the bend angle is less than twice the transition angle, then the springback is given by the equation:

$$\Delta\Theta = \frac{1}{4}\,\frac{M_m R}{E I}\,\frac{\Theta_T^2}{\Theta_2} \quad (1)$$

where $\Delta\Theta$=springback

R=radius of curvature of the neutral surface

E=modulus of elasticity

I=moment of inertia of the distorted cross section

If the total bend angle is greater than twice the transition angle, then the springback is given by the equation.

$$\Delta\Theta = \frac{M_m R}{E I}(\Theta_T-\Theta_2) \quad (2)$$

In the springback formulas 1 and 2 above, the moment of inertia of the distorted cross section, I, must be calculated from the moment of inertia of the undistorted cross section, $I_o$. This may be done in three ways, by theoretical calculation, by tabulation of experimental results, or by direct measurement of tube flattening. Theoretical calculation can be based on Brazier's formula and its extensions, although these formulas are known to be accurate only to a first approximation. Experimental results can be tabulated based on bends of similar materials under conditions of geometric similitude (see FIGS. 3, 4 and 5). Lastly, flattening can be measured directly on the bending machine by using a contact probe that measures the outer surface of the bent tube.

Figure 9:
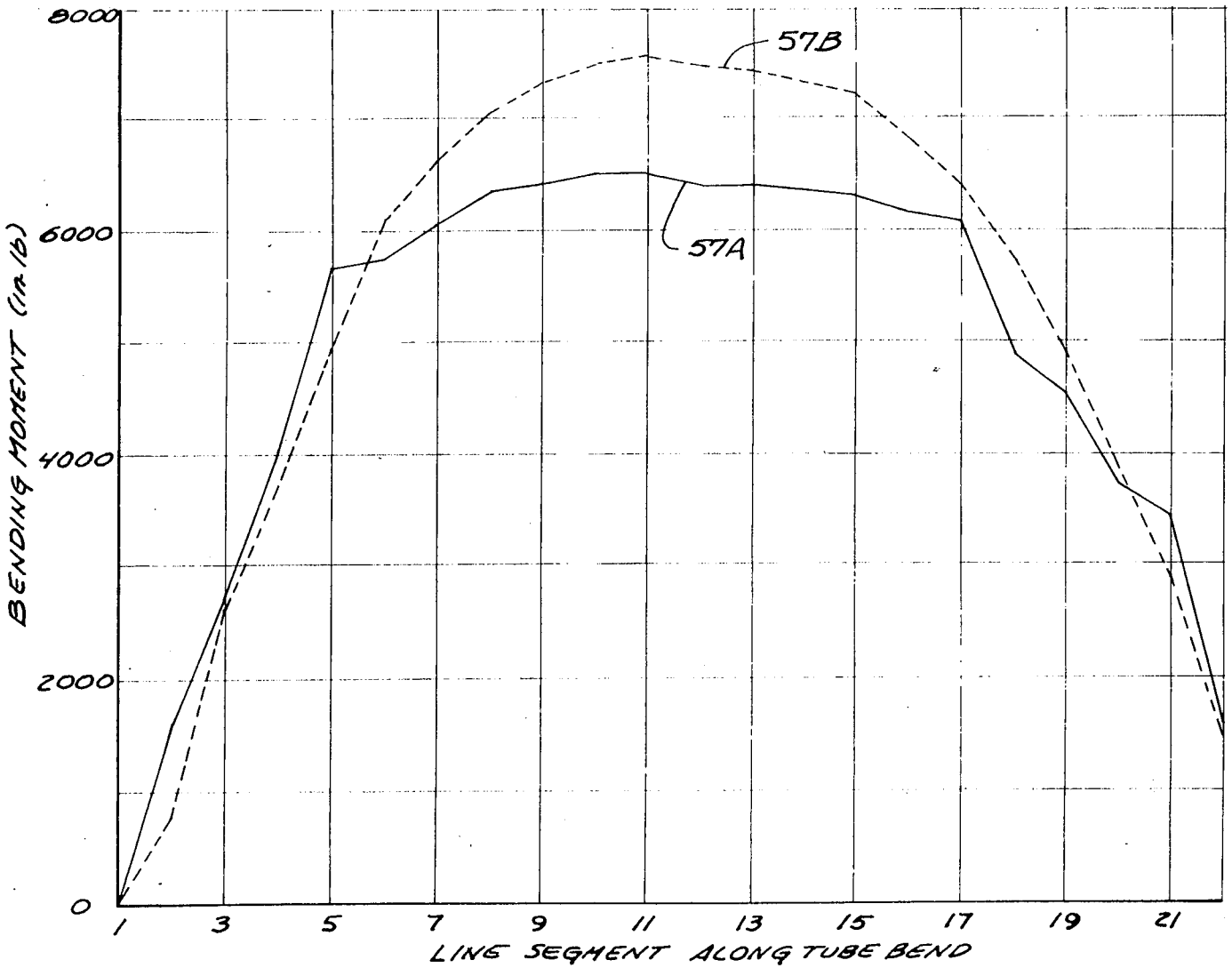
FIG. 9 is a schematic representation illustrating bending moments at different sections of the tube, taking into account the tube's cross section distortion and neutral axis shift and a theoretical curve neglecting cross sectional distortion and neutral axis shifts.

FIG. 9 plots calculated bending moment at the tube sections shown in FIG. 3. The solid line curve 57A takes the tube cross section distortion and neutral axis shift into account and the dashed line curve 57B neglects cross sectional distortion and neutral axis shift. In operation the input moments of inertia for equations 1 and 2 are made to take into account tube flattening.

The equations given above show the spring back angle, for the two situations that are illustrated in FIGS. 6 and 7. Also, the relationship between springback (vertical) and bend angle (horizontal) is shown in FIG. 8 graphically, with the equations used indicating the line segments for the plot line 58, including the relationship where the bend angle is less than twice the transition angle, shown at 59, and where the total angle of bend is greater than twice the transition angle.

This information can be provided to a computer or micro processor illustrated at 60. An input as to the bend angle desired indicated at 61 is provided along with inputs from the shaft encoder 45 along a line 62, an output to the clamp along a line 63, a measured bend moment signal from circuit 44 along a line 64, and an input 65 to the algorithm that indicates the change in moment of inertia during a bend which can be, as stated above, calculated, or derived experimentally. Additionally, a flattening probe sensor indicated at 66 can be used directly on the tube to sense flattening to provide an indication of the change in moment of inertia to the computer for calculating the moment of inertia of the distorted cross sections in each of equations I and 2 above. The transition angle $\Theta_2$ for the tube is also inputted with a signal from a suitable circuit 66A.

The computer 60 can be any suitable microprocessor that is programmed to provide the necessary functions, including providing an output signal to a valve 67 that will control the fluid pressure cylinder 64, and a signal to a tube feed device indicated at 72. The tube feed device or a sensor also can provide a feedback signal based on actual tube movement for closed loop control.

The clamp signal on line 63 also would be an output for a sequential control, wherein when a bend is started the tube would be unclamped and fed into the die. The tube would then be clamped, and then the actuator 34 would be actuated so that the bend angle indicated by the shaft encoder (or other suitable encoders for determining movement of the die and tube during bending) indicates the progress of the bend. The bend angle indicated is correlated with the signal along line 64 to derive the measured moment ($M_m$). Material properties such as the modulus of elasticity are set and provided by an input 75 and a radius signal input 76 is provided to the computer so the algorithm shown as equations 1 and 2 can be solved on a real time basis. The spring back angle necessary either when the bend angle is less or more than the transition section angle can be accommodated.

Normal programming takes care of the control, and provides the sequence of operations.

Suitable mechanisms for reset of the die indicated at 78 would be provided to the drive shaft 11 on the die, such as to a hydraulic motor indicated at 79, which would drive the die back to its original position, after the clamp 20 had been released. The actuator 34 is permitted to return to its original position. The tube feed 72 would then operate to feed in a new length of tube, and if necessary suitable cuts could be made or the tube can be rotated as desired.

In this way an adaptive control for tube bending on a real time basis is provided.

The same calculations will apply to workpieces with other cross sections besides an annulus. Where some other cross section is used, the change in moment of inertia would be different. Analogous observations for the change in moment of inertia for the distortion of other than an annular cross section during bending can be determined.

Equations 1 and 2 can be adapted to apply to deformation processes that combine bending with other effects, such as a combined bending and torsion in the fabrication of helical springs. For thin wall tubes, as shown in FIG. 2, mandrels are often used to reduce cross sectional distortion, and the moment distribution and the cross section distortion will be affected by the use of mandrels. The flattening of the tube, when a mandrel is used, can be sensed with a probe 66 positioned along the bend and which senses the flattening of the tubular section or experimental results for a tube size and cross section can provide the necessary moment of inertia.

Although the present invention has been described with reference to preferred embodiments, workers skilled in the art will recognize that changes may be made in form and detail without departing from the spirit and scope of the invention.

What is claimed is:

1. An apparatus for correcting for spring back in bending tubes comprising: a bending die, means for holding a tube on the bending die, guide means for guiding the tube as it is moved by the die during bending, means for driving said bending die to bend a tube a selected number of degrees, said means for driving including means for measuring a function of force exerted by the means for driving, means for correlating the measured function of force and the effective lever arm through which the measured function of force acts to move the bending die to determine the bending moment needed for bending the tube on the bending die, means providing a signal indicating the moment of inertia of the tube being bent, and control means for operating the means for driving responsive to the signal indicating the moment of inertia and to the means for correlating the measured function of force and the effective lever arm to drive the means for driving to cause overbending of the tube an amount proportional to the determined bending moment to compensate for springback of a tube being bent.

2. The apparatus as specified in claim 1, said control means including means for compensating for the moment of inertia of the distorted cross section.

3. The apparatus as specified in claim 2, the control means including means for calculating a spring back angle of overbending movement by the bending die in accordance with one of the following equations as a function of the total bend angle:

$$\Delta\Theta = \frac{1}{4}\ \frac{M_m R}{E I}\ \frac{\Theta_T^2}{\Theta_2} \tag{1}$$

$$\Delta\Theta = \frac{M_m R}{E I}(\Theta_T - \Theta_2) \tag{2}$$

Where:

$M_m$ is the measured bending moment

R is the radius of curvature of the neutral axis of the tube

E is the modulus of elasticity of the tube material

I is the moment of inertia of the tube $\Theta_T$ is the total bend angle $\Theta_2$ is the transition angle of the bend.

4. The apparatus of claim 1 wherein said die is rotatable and the means for measuring the function of force comprises a load cell measuring tension loads tending to rotate the die through a known lever arm.

5. The apparatus of claim 1 wherein said means for driving said bending die comprises a rotatable member connected to drive the bending die and having an outer periphery, a flexible member connected to said outer periphery and partially wrapped therearound, and a fluid pressure actuator means for exerting a tension load on said flexible member to tend to rotate said bending die, said means for measuring the bending moment including means for measuring the tension load exerted by said fluid pressure actuator means.

6. The apparatus as specified in claim 1 wherein said control means includes means for providing a signal indicating the radius of bend, the bend angle desired, and the elastic modulus of the material of the tube.

7. An apparatus for bending tubes comprising a bending die having a rotatable die element, power means for driving said rotatable die element to bend a tube, means for measuring loads exerted by the power means on said bending die while bending such tube, and means for determining the bending moment on said tube during the driving of said rotatable die element.

8. The apparatus as specified in claim 7 and control means coupled to said means for determining the bending moment on said die to control bending of such tube to a desired number of degrees of bend sufficient to compensate for spring back determined by an algorithm resolved by said control means.

9. The apparatus of claim 8 wherein said control means includes means for indicating the transition angles of a bend for such tubes before a bend angle is achieved, and including means to select different algorithms based on whether the total bend angle is greater or less than twice the transition angle.

10. The method of bending a tube to compensate for springback from a conventional bending die comprising:

placing a tube in a bending die;

moving the bending die to bend the tube;

measuring the forces exerted on the bending die and determining the bending moment required for movement of the bending die as the tube is bent;

calculating the springback angle of the tube being bent as a function of the bending moment determined during bending; and overbending the tube by an angular amount substantially equal to the calculated springback angle.

11. The method of claim 10 including the further step of determining the change in moment of inertia caused by distortion of the tube cross section during the bending process as a part of the step of calculating springback.

* * * * *